US007816854B2

(12) United States Patent
Ryu et al.

(10) Patent No.: US 7,816,854 B2
(45) Date of Patent: Oct. 19, 2010

(54) LIGHT EMISSION DEVICE AND SPACERS THEREFOR

(75) Inventors: Kyung-Sun Ryu, Yongin-si (KR); Pil-Goo Jun, Yongin-si (KR); Su-Joung Kang, Yongin-si (KR); Jong-Hoon Shin, Yongin-si (KR); Kyu-Won Jung, Yongin-si (KR); Sang-Jin Lee, Yongin-si (KR); Jin-Ho Lee, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 383 days.

(21) Appl. No.: 11/875,749

(22) Filed: Oct. 19, 2007

(65) Prior Publication Data

US 2008/0111952 A1 May 15, 2008

(30) Foreign Application Priority Data

Nov. 14, 2006 (KR) ..... 10-2006-0112200

(51) Int. Cl.
*H01J 17/49* (2006.01)

(52) U.S. Cl. ..... 313/496; 313/497

(58) Field of Classification Search ..... 313/495–497
See application file for complete search history.

(56) References Cited

U.S. PATENT DOCUMENTS 7,629,731 B2 * 12/2009 Tsai et al. ..... 313/346 R
2004/0021624 A1 * 2/2004 Hirasawa et al. ..... 345/75.2
2004/0041507 A1 3/2004 Ito
2005/0052116 A1 3/2005 Yaguchi et al.

FOREIGN PATENT DOCUMENTS

| | | |
|---|---|---|
| JP | 2006-193382 | 7/2006 |
| KR | 10-0766925 B1 | 10/2007 |
| WO | WO 96/30926 A1 | 10/1996 |
| WO | WO 98/07066 A1 | 2/1998 |
| WO | WO 99/36937 A1 | 7/1999 |
| WO | WO 03/077013 A2 | 9/2003 |

OTHER PUBLICATIONS

European Search Report, Application No. EP 07120158, Jun. 9, 2008.

* cited by examiner

*Primary Examiner*—Nimeshkumar D Patel
*Assistant Examiner*—Anne M Hines
(74) *Attorney, Agent, or Firm*—Christie, Parker & Hale, LLP

(57) ABSTRACT

A light emission device and a display device having the light emission device are provided. A light emission device includes first and second substrates facing each other to form a vacuum envelope. An electron emission unit is provided on the first substrate. A light emission unit is provided on the second substrate to emit light using electrons emitted from the electron emission unit. A spacer uniformly maintains a gap between the first and second substrates. The spacer has a surface resistivity within a range of $10^{12}$-$10^{14}$ Ωcm.

19 Claims, 7 Drawing Sheets

LIGHT EMISSION DEVICE AND SPACERS THEREFOR

CROSS-REFERENCES TO RELATED APPLICATION

This application claims priority to and the benefit of Korean Patent Application No. 10-2006-0112200 filed on Nov. 14, 2006, in the Korean Intellectual Property Office, the entire content of which is incorporated herein by reference.

BACKGROUND OF THE INVENTION

1. Field of the Invention

The present invention relates to display devices and, more particularly, to light emission devices and spacers therefor.

2. Description of the Related Art

A liquid crystal display, which is one of a variety of flat panel display devices, displays an image by varying the light transmission amount at each pixel using the dielectric anisotropy property of liquid crystals whose twisting angle varies according to the voltage applied.

The liquid crystal display includes a liquid crystal panel assembly and a backlight unit for emitting light toward the liquid crystal panel assembly. The liquid crystal panel assembly displays a predetermined image by receiving light emitted from the backlight unit and transmitting or intercepting the light using a liquid crystal layer.

The backlight unit is classified according to the light source into different types, one of which is a cold cathode fluorescent lamp (CCFL) type. The CCFL is a linear light source that can uniformly emit the light to the liquid crystal panel assembly through optical members such as a diffusion sheet, a diffuser plate, and a prism sheet.

However, in the CCFL type backlight unit, since the light emitted from the CCFL travels through the optical members, there may be light loss. Considering the light loss, a relatively high intensity of light must be emitted from the CCFL. This causes an increase in power consumption. Furthermore, since it is difficult to increase the size of the CCFL type backlight unit due to structural limitations, the CCFL type backlight unit cannot be applied to large-sized display devices over 30-inch.

In addition, a light emission diode (LED) type backlight unit is also well known. The LED type backlight unit includes a plurality of LEDs and optical members such as a reflection sheet, a waveguide plate, a diffusion sheet, a diffuser plate, a prism sheet, and the like. The LED type backlight unit has a fast response time and excellent color reproduction. However, the LED type backlight unit is costly and increases the overall thickness of the display device.

Therefore, in recent years, a field emission type backlight unit that emits light using electron emission provided by an electric field has been developed to replace the CCFL and LED type backlight units. The field emission type backlight unit is a surface light source, which has relatively low power consumption and can be of large-size.

In the field emission type backlight unit, spacers are disposed between first and second substrates to endure the compression force generated by the pressure difference between an interior and exterior of a vacuum envelope. The spacers are exposed to the space along which electrons travel and thus the electrons collide with the spacers. As a result of the collision with the electrons, the spacers become electrically charged. The electrically charged spacers distort the electron beam path. In order to prevent the distortion of the electron beam path, a technology for coating a resistive layer on the surface of the spacer has been developed.

However, when the spacer coated with the resistive layer is applied to a field emission type backlight unit, it cannot endure the high voltage applied to an anode electrode and thus a short circuit may be generated between a driving electrode and the anode electrode.

As described above, conventional backlight units, including the field emission type backlight unit, have inherent problems. In addition, conventional backlight units must maintain a predetermined brightness when the display device is driven. Therefore, it becomes difficult to improve the display quality of the display device to a sufficient level.

For example, when the liquid crystal panel assembly is to display an image having a high luminance portion and a low luminance portion in response to an image signal, it will be possible to realize an image having a more improved dynamic contrast if the backlight unit can emit light having different intensities to the respective high and low luminance portions.

However, since the conventional backlight units cannot achieve the above function, improving the dynamic contrast of the image of the display device becomes limited.

SUMMARY OF THE INVENTION

The present invention provides a light emission device having a spacer having an optimal surface resistivity that can endure a high voltage applied to the anode electrode and effectively discharge electric charges to an external side.

The present invention also provides a light emission device that can independently control light intensities of a plurality of divided regions of a light emission surface, and a display device that can enhance the dynamic contrast of the image by using the light emission device as a backlight unit.

According to one embodiment of the present invention, there is provided a light emission device including: first and second substrates facing each other to form a vacuum envelope. An electron emission unit is provided on the first substrate. A light emission unit is provided on the second substrate to emit light using electrons emitted from the electron emission unit. A spacer uniformly maintains a gap between the first and second substrates, the spacer having a surface resistivity within a range of $10^{12}$-$10^{14}$ Ωcm.

The spacer may include a spacer body and a coating layer formed on a surface of the spacer body, the coating layer having a resistivity within the range of $10^{12}$-$10^{14}$ Ωcm.

The coating layer may be formed on a side surface of the spacer body.

Alternatively, the coating layer may be formed on one of top and bottom surfaces of the spacer body. The coating layer may have a thickness within a range of 2-4 mm.

Alternatively, the coating layer may be formed on an entire surface of the spacer body.

The coating layer may contain chrome oxide.

The spacer may be formed in one of a pillar-type or a wall-type.

The light emission unit may include a phosphor layer and an anode electrode formed on a surface of the phosphor layer, wherein the anode electrode receives a voltage within a range of 10-15 kV.

The phosphor layer may be divided into a plurality of sections and a black layer is formed between the sections.

The electron emission unit may include first and second electrodes crossing each other and insulated from each other and an electron emission region electrically connected to one of the first and second electrodes.

The spacer may contact one of the first and second electrodes.

The electron emission region may be formed of a material including at least one of a carbon-based material and a nanometer-sized material.

According to another exemplary embodiment of the present invention, there is provided a display device including: the above-described light emission device and a panel assembly disposed in front of the light emission device to display an image by receiving light emitted from the light emission device.

The panel assembly includes a plurality of first pixels and the light emission device includes a plurality of second pixels, the number of which is less than that of the first pixels, the second pixels emitting different intensities of light.

The number of first pixels arranged in each row of the panel assembly may be more than 240 and the number of first pixels arranged in each column of the panel assembly may be more than 240.

The number of second pixels arranged in each row of the light emission device may be within a range of 2-99 and the number of second pixels arranged in each column of the light emission device may be within a range of 2-99.

The panel assembly may be a liquid crystal panel assembly.

DETAILED DESCRIPTION

Figure 1:
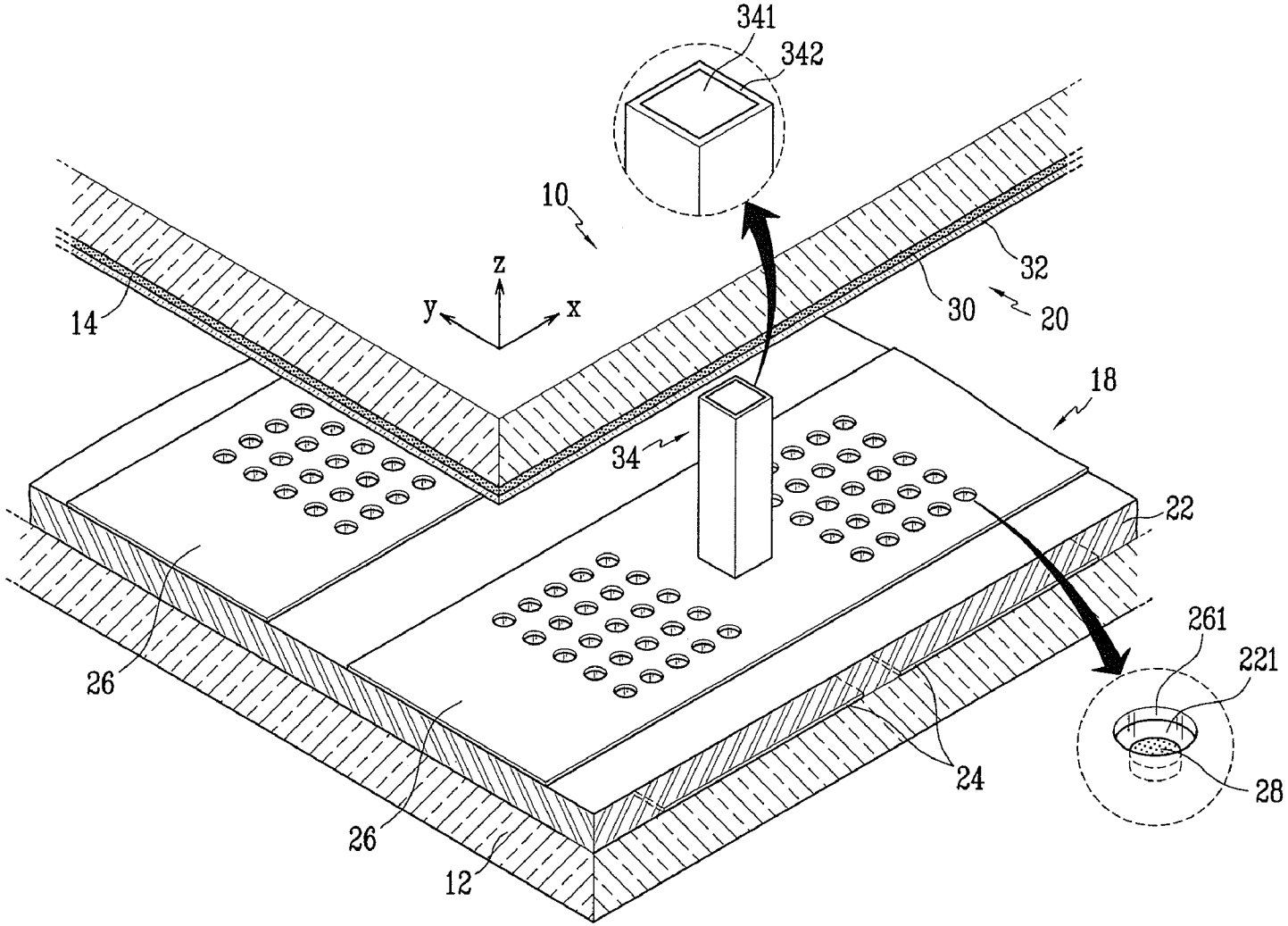
FIG. 1 is a partial exploded perspective view of a light emission device according to an exemplary embodiment of the present invention.
Figure 2:
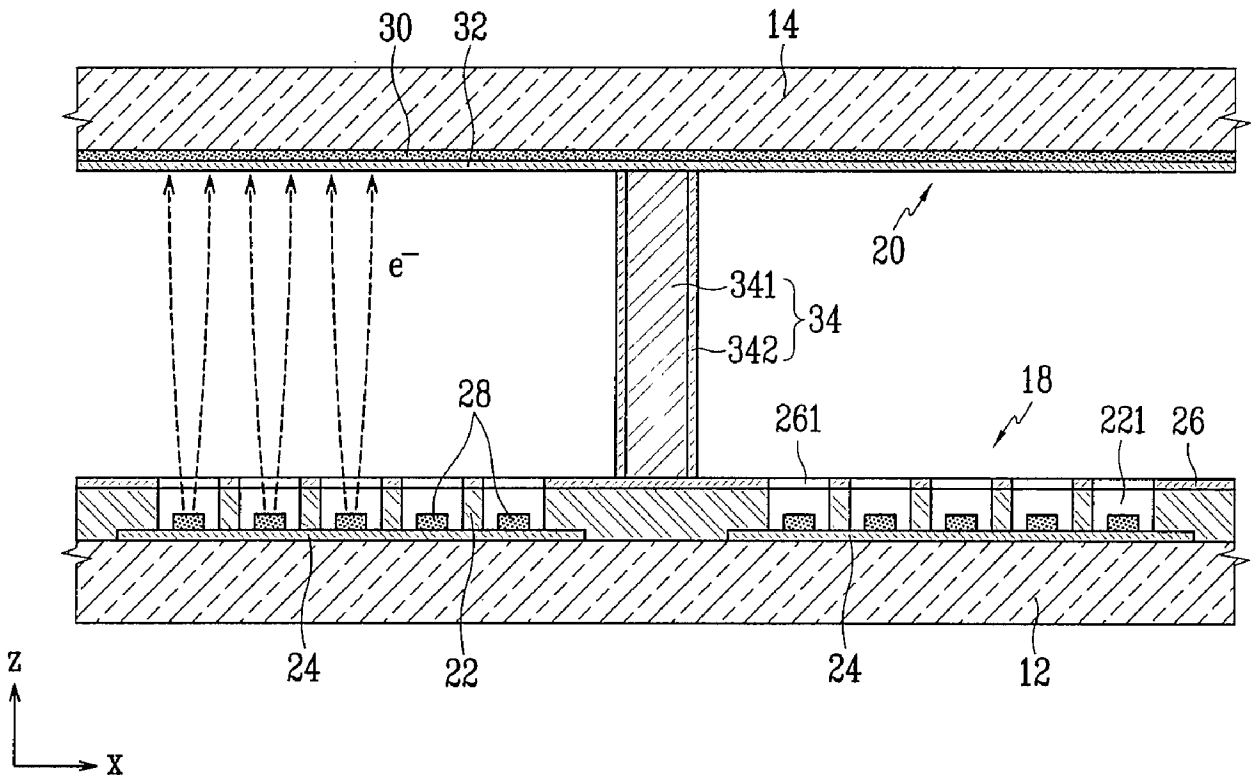
FIG. 2 is a partial sectional view of the light emission device of FIG. 1.

Referring to FIGS. 1 and 2, a light emission device 10 of the present embodiment includes first and second substrates 12, 14 facing each other at a predetermined interval. A sealing member (not shown) is provided at the peripheries of the first and second substrates 12, 14 to seal them together and thus form a vacuum envelope. The interior of the vacuum envelope is kept to a degree of vacuum of about $10^{-6}$ torr.

Each of the first and second substrates 12, 14 is divided into an effective region for emitting visible light and an ineffective region surrounding the effective region. An electron emission unit 18 for emitting electrons is provided on the first substrate 12 at the effective region and a light emission unit 20 for emitting the visible light is provided on the second substrate 14 at the effective region.

The electron emission unit 18 includes first and second electrodes 24, 26 formed in stripe patterns crossing each other with an insulation layer 22 interposed between the first and second electrodes 24, 26. Electron emission regions 28 are electrically connected to the first electrodes 24 or the second electrodes 26.

When the electron emission regions 28 are formed on the first electrodes 24, the first electrodes 24 function as cathode electrodes applying a current to the electron emission regions 28 and the second electrodes 26 function as gate electrodes inducing the electron emission by forming an electric field around the electrode emission regions 28 according to the voltage difference between the cathode and gate electrodes. Alternatively, when the electron emission regions 28 are formed on the second electrodes 26, the second electrodes 26 function as the cathode electrodes and the first electrodes 24 function as the gate electrodes.

Among the first and second electrodes 24, 26, the second electrodes 26 arranged in columns (the x-axis in FIGS. 1 and 2) of the light emission device 10 function as scan electrodes and the first electrodes 24 are arranged in rows (the y-axis in FIGS. 1 and 2) of the light emission device 10 function as data electrodes.

In FIGS. 1 and 2, an embodiment where the electron emission regions 28 are formed on the first electrodes 24, the first electrodes 24 are arranged in rows of the light emission device 10, and the second electrodes 26 are arranged in columns of the light emission device 10 is illustrated. However, the arrangement of the first and second electrodes and the location of the electron emission regions 28 are not limited to this case.

In the present embodiment, openings 261, 221 corresponding to the respective electron emission regions 28 are formed in the second electrodes 26 and the insulation layer 22 at each crossed region of the first and second electrodes 24, 26 to partly expose the surface of the first electrodes 24 and the electron emission regions 28 are formed on the exposed portions of the first electrodes 24 through the openings 221 of the insulation layer 22.

The electron emission regions 28 are formed of a material emitting electrons when an electric field is applied thereto under a vacuum atmosphere, such as a carbon-based material or a nanometer-sized material.

The electron emission regions 28 can be formed of carbon nanotubes, graphite, graphite nanofibers, diamonds, diamond-like carbon, fullerene $C_{60}$, silicon nanowires or a combination thereof. The electron emission regions 28 may be formed through a screen-printing process, a direct growth, a chemical vapor deposition, or a sputtering process.

Considering the diffusion property of an electron beam, the electron emission regions 28 are not formed at an edge of the crossed region of the first and second electrodes 24, 26 but are located at a central area of the crossed region of the first and second electrodes 24, 26.

One crossed region of the first and second electrodes 24, 26 may correspond to one pixel region of the light emission device 10. Alternatively, two or more crossed regions of the first and second electrodes 24, 26 may correspond to one pixel region of the light emission device 10. In latter case, two or more first electrodes 24 and/or two or more second electrodes 26 that are placed in one pixel region are electrically connected to each other to receive a common drive voltage.

The light emission unit 20 includes a phosphor layer 30 and an anode electrode 32 disposed on the phosphor layer 30. The phosphor layer 30 may be a white phosphor layer or a combination of red, green and blue phosphor layers. In the present embodiment, the former is illustrated.

The white phosphor layer may be formed on the entire effective region of the second substrate 14 or patterned to have a plurality of sections corresponding to the respective pixel regions. The combination of the red, green and blue phosphors may correspond to one pixel region. In this case, a black layer may be formed between the red, green and blue phosphors.

The anode electrode 32 may be formed of metal such as aluminum (Al) while covering the phosphor layer 30. The anode electrode 32 is an acceleration electrode that receives a high voltage to maintain the phosphor layer 30 at a high electric potential state. The anode electrode 32 functions to enhance the luminance by reflecting the visible light, which is emitted from the phosphor layer 30 to the first substrate 12, toward the second substrate 14.

The anode electrode 32 may be applied with a high voltage higher than 10 kV, preferably 10-15 kV. Therefore, the light emission device of the present embodiment can realize a maximum luminance higher than 10,000 cd/$m^2$ at a central portion of the effective region.

Since a high voltage is applied to the anode electrode 32, a gap between the first and second substrates 12, 14 may be within a range of, for example, 5-20 mm that is greater than that of a conventional field emission type backlight unit.

Disposed between the first and second substrates 12, 14 are spacers 34 for uniformly maintaining a gap between the first and second substrates 12, 14 against an outer force.

The spacers 34 have a surface resistivity within the range of $10^{12}$-$10^{14}$ Ωcm. To realize this, each of the spacers 34 includes a spacer body 341 formed of glass or ceramic and a coating layer 342 formed on a side surface of the spacer body 341.

The coating layer 342 has a resistivity within the range of $10^{12}$-$10^{14}$ Ωcm identical to the surface resistivity. When the resistivity of the coating layer 342 is less than $10^{12}$ Ωcm, the coating layer cannot endure the high anode voltage applied to the anode electrode 32 and thus a short circuit may occur between the first and second electrodes 24, 26. When the resistivity of the coating layer 342 is greater than $10^{14}$ Ωcm, the electric charges formed in the spacers 34 cannot be effectively discharged through the coating layer 342 due to the high resistivity.

That is, when the coating layer 342 has the resistivity within the range of $10^{12}$-$10^{14}$ Ωcm, the electric charges formed on the spacers 34 can be optimally discharged.

The coating layer 342 may be formed in a variety of materials containing, for example, chrome oxide.

As shown in FIG. 1, the spacers 34 may be placed to contact the second electrode 26 so that the electric charges formed on the spacers 34 can be discharged to an external side through the coating layer 342 and the second electrodes 26. In the present embodiment, although a case where the spacers 34 contact the second electrodes 26 is illustrated, the present invention is not limited to this case. That is, the spacers 34 may be placed to alternatively contact the first electrodes 24.

The light emission device 10 is driven by applying a predetermined voltage to the first and second electrodes 24, 26 and applying more than thousands volts of a positive DC voltage to the anode electrode 32.

Then, an electric field is formed around the electron emission regions 28 at pixel regions where the voltage difference between the first and second electrodes 24, 26 is higher than a threshold value, thereby emitting electrons from the electron emission regions 28. The emitted electrons are accelerated by the high voltage applied to the anode electrode 32 to collide with the corresponding phosphor layer 30, thereby exciting the phosphor layer 30. The light emission intensity of the phosphor layer 30 at each pixel corresponds to the electron emission amount of the corresponding pixel.

When the spacers 34 are charged with electric charges during the above-described driving procedure, a current flows between the anode electrode 32 and the second electrodes 26 through the coating layer 342. By this current flow, the electric charges formed on the spacers 34 are discharged to the external side through the second electrodes 26. Accordingly, the charging of the spacers 34 and the distortion of the electron beam can be prevented.

Figure 3:
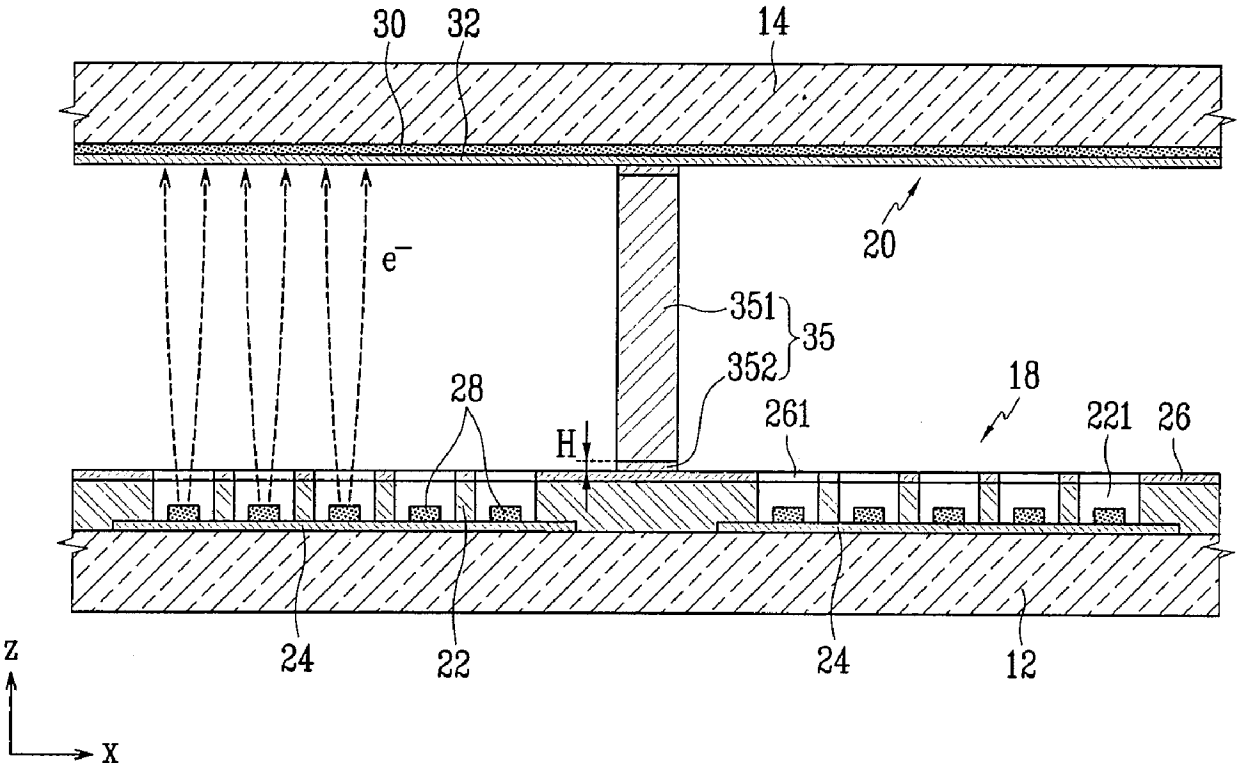
FIG. 3 is a partial sectional view of a light emission device according to another exemplary embodiment of the present invention.
Figure 4:
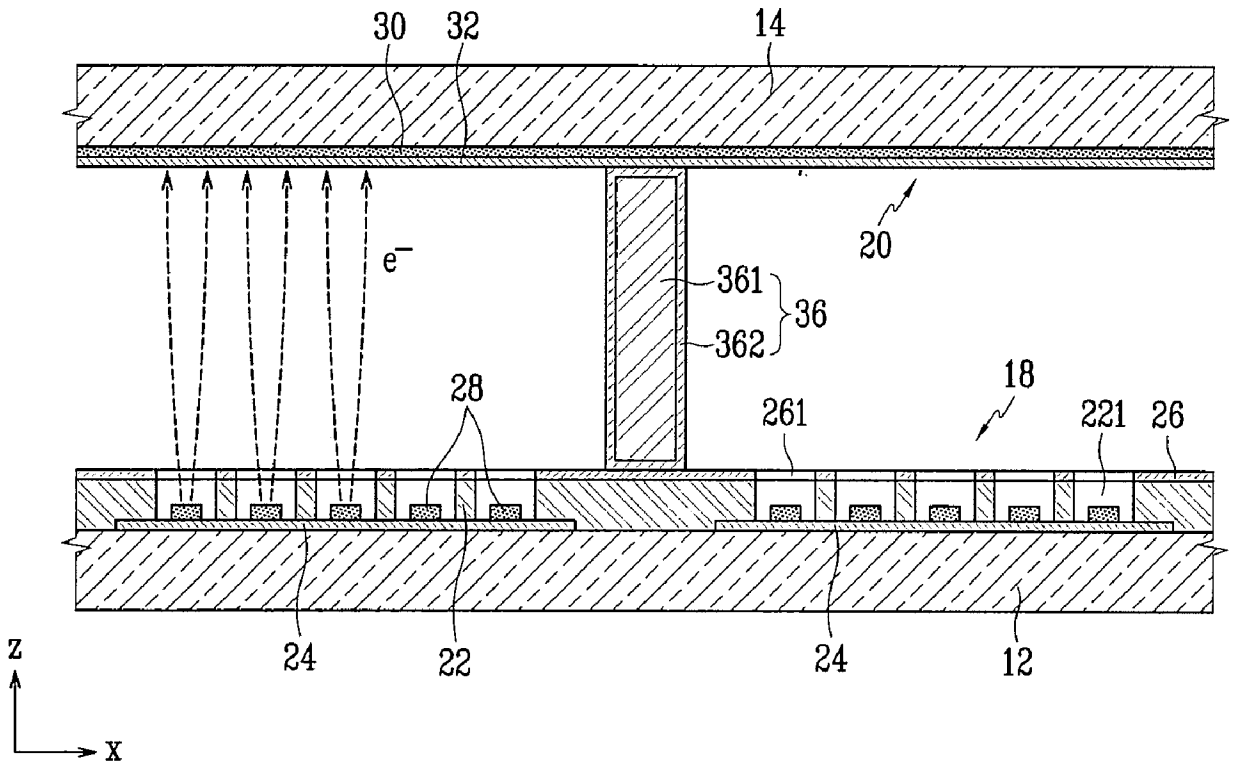
FIG. 4 is a partial sectional view of a light emission device according to still another exemplary embodiment of the present invention.

FIG. 3 is a partial sectional view of a light emission device according to another exemplary embodiment of the present invention, and FIG. 4 is a partial sectional view of a light emission device according to still another exemplary embodiment of the present invention. Two examples of alternative coating layering are illustrated.

Referring first to FIG. 3, a spacer 35 includes a spacer body 351 and a coating layer 352 formed on at least one of the top and bottom surfaces of the spacer body 351. An exemplary thickness of the coating layer 352 may be within the range of 2-4 mm.

Referring to FIG. 4, a spacer 36 includes a spacer body 361 and a coating layer 362 formed on an entire surface of the spacer body 361.

Figure 5:
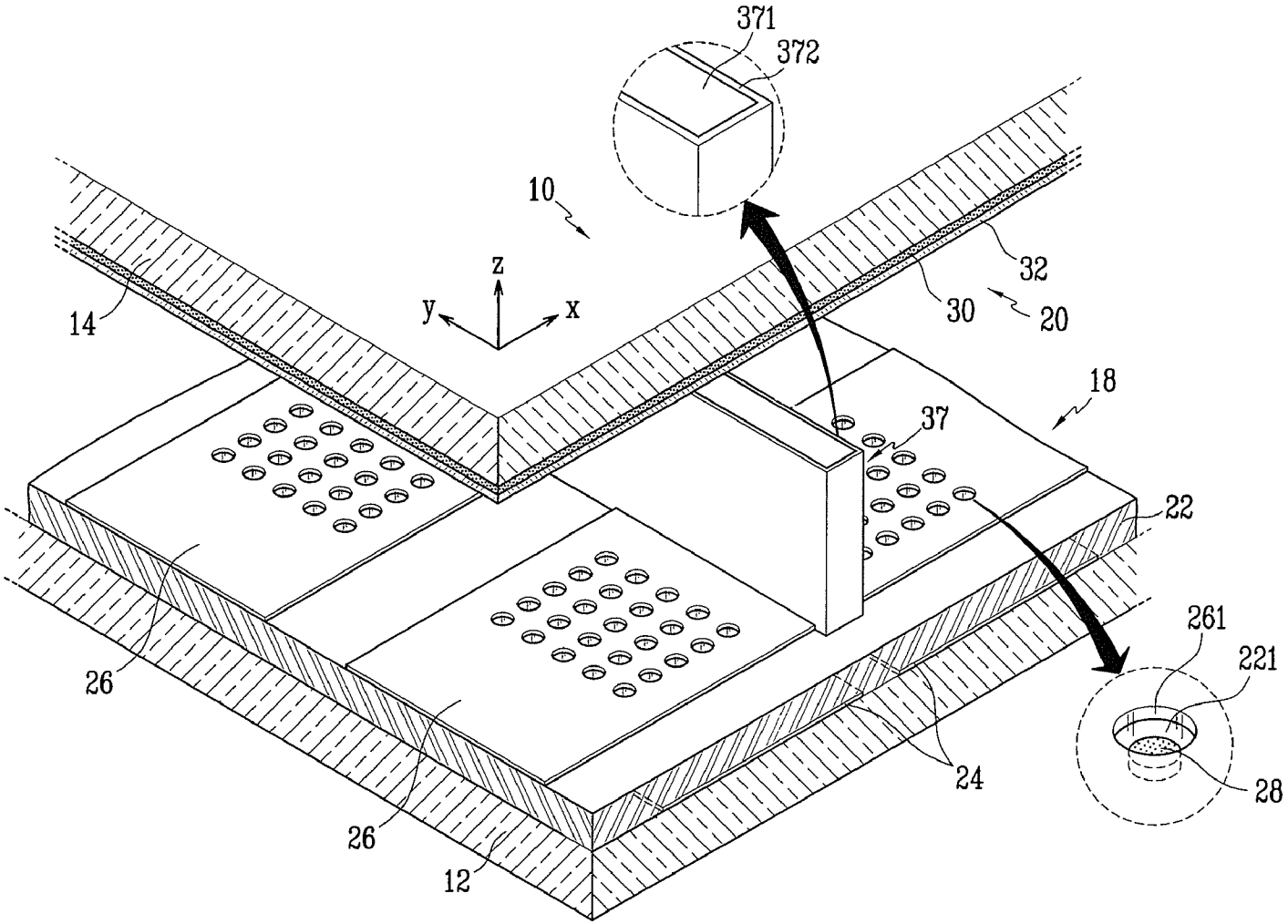
FIG. 5 is a partial exploded perspective view of a light emission device according to still yet another exemplary embodiment of the present invention.

FIG. 5 is a partial exploded perspective view of a light emission device according to still yet another exemplary embodiment of the present invention.

In the foregoing embodiments, all of the spacers are pillar shaped having a generally square cross-section. However, in the embodiment shown in FIG. 5, a spacer 37 includes a spacer body 371 having wall shape and has a coating layer 372 formed on a surface of the spacer body 371.

That is, the shape of the spacer may take a variety of shapes.

Figure 6:
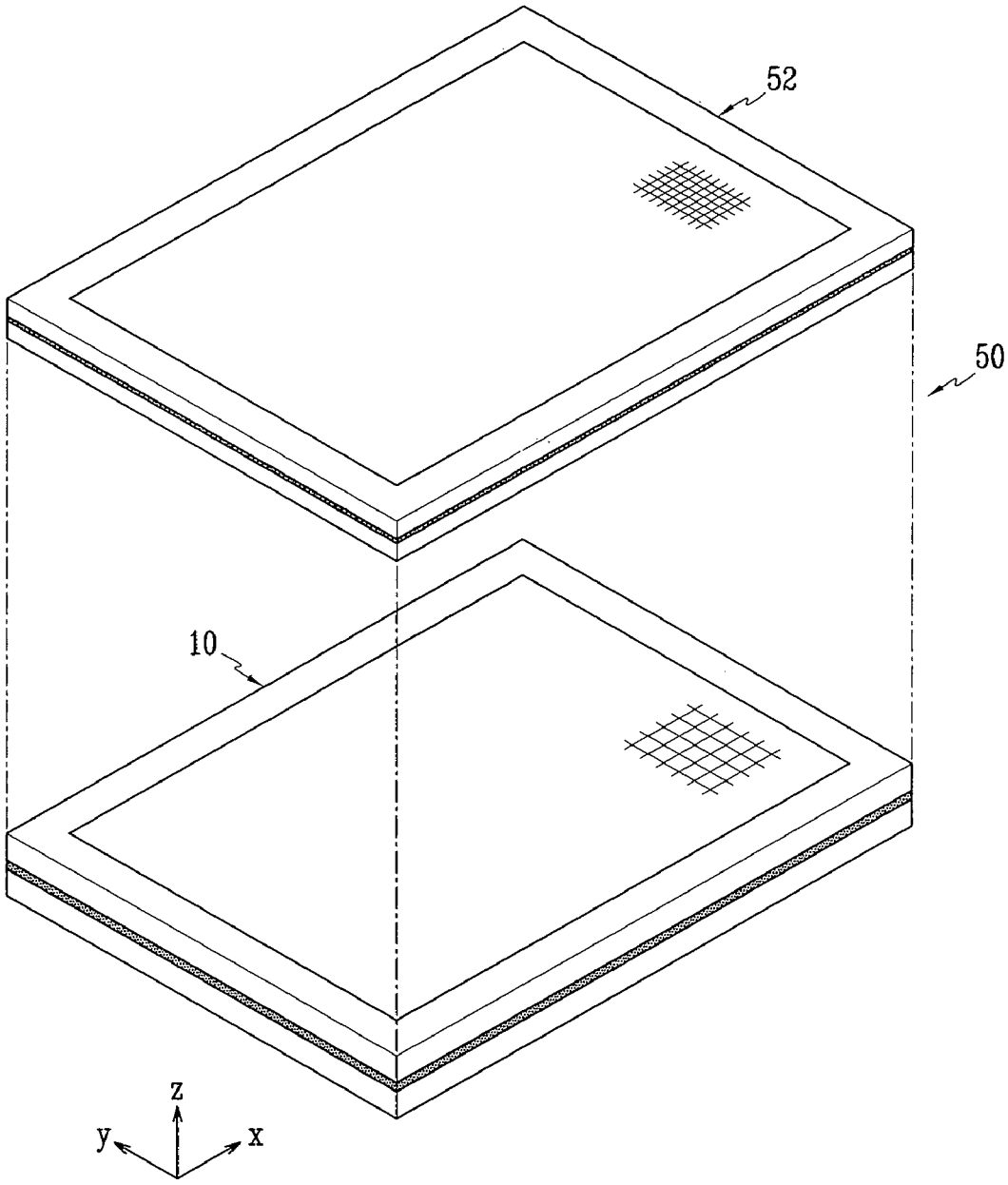
FIG. 6 is a partial exploded perspective view of a display device according to a further embodiment of the present invention.

FIG. 6 is an exploded perspective view of a display device according to a further embodiment of the present invention.

Referring to FIG. 6, a display device 50 includes a panel assembly 52 having a plurality of pixels arranged in rows and columns and a light emission device (backlight unit) 10 disposed in rear of the panel assembly 52 to emit light toward the panel assembly 52. A liquid crystal panel assembly can be used as the panel assembly 52 and one of the light emission devices 10 of FIGS. 1 through 5 can be used as the backlight unit.

If necessary, an optical member (not shown) such as a diffuser plate or a diffuser sheet can be interposed between the panel assembly 52 and the backlight unit 10.

The columns are defined in a horizontal direction (the x-axis of FIG. 6) of a screen of the display device 50. The rows are defined in a vertical direction (the y-axis of FIG. 6) of the screen of the display device 50.

In the present embodiment, the number of pixels of the light emission device 10 is less than that of the panel assembly 52 so that one pixel of the light emission device 10 corresponds to two or more pixels of the panel assembly 52.

When the number of pixels arranged along the column of the panel assembly 52 is M and the number of pixels arranged along the row of the panel assembly 52 is N, the resolution of the panel assembly 52 can be represented as M×N. When the number of pixels arranged along the column of the light emission device 10 is M' and the number of pixels arranged along the row of the light emission device 10 is N', the resolution of the light emission device 10 can be represented as M'×N'.

In this embodiment, the number of pixels M is defined as a positive number higher than 240 and the number of pixels N is defined as a positive number higher than 240. The number of pixels M' is as one of the positive numbers within the range of 2-99 and the number of pixels N' is defined as one of the positive numbers within the range of 2-99.

The light emission device 10 is an emissive display panel having an M'×N' resolution and each pixel of the light emission device 10 emits a predetermined intensity of light to one or more corresponding pixels of the panel assembly 52.

Figure 7:
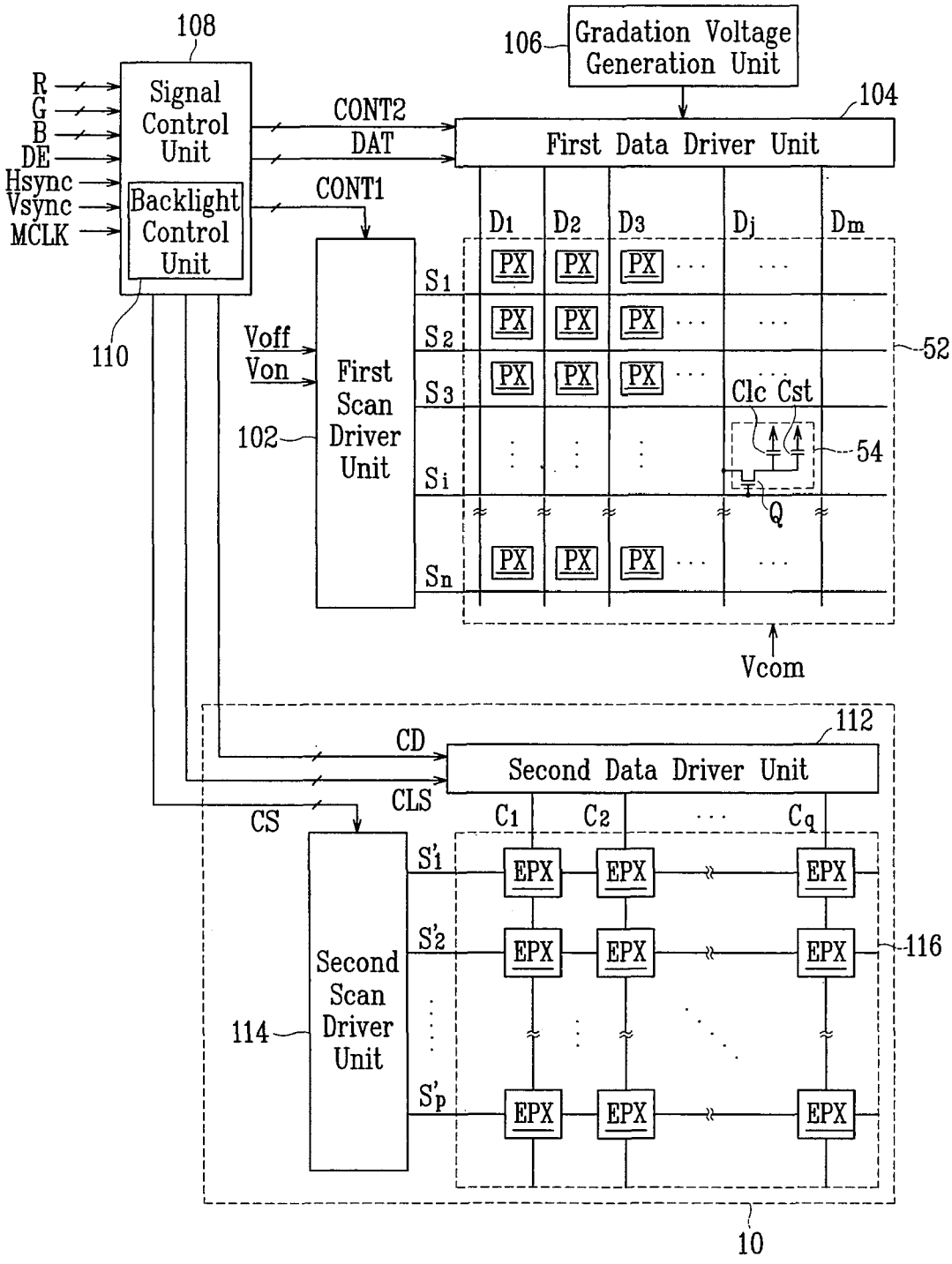
FIG. 7 is a block diagram of a driving part of a display device according to a still further embodiment of the present invention.

FIG. 7 is a block diagram of a driving part of the display device according to a still further embodiment of the present invention.

Referring to FIG. 7, a driving part of the display device includes first scan and first data driver units 102, 104 connected to the panel assembly 52, a gradation voltage generation unit 106 connected to the first data driver unit 104, second scan and second data driver units 114, 112 connected to a display unit 116 of the light emission device 10, a backlight control unit 110 for controlling the light emission device 10, and a signal control unit 108 for controlling the panel assembly 52. The signal control unit 108 includes the backlight control unit 110.

When considering the panel assembly 52 as an equivalent circuit, the panel assembly 52 includes a plurality of signal lines and a plurality of first pixels PX arranged along rows and columns and connected to the signal lines. The signal lines include a plurality of first scan lines $S_1$-$S_n$ for transmitting first scan signals and a plurality of first data lines $D_1$-$D_m$ for transmitting first data signals.

Each pixel, e.g., a pixel 54 connected to an $i_{th}$ (i=1, 2, . . . n) first scan line $S_i$ and a $j_{th}$ (j=1, 2, . . . m) first data line $D_j$ includes a switching element Q connected to the $i_{th}$ scan line $S_i$ and the $i_{th}$ data line $D_j$, a liquid crystal capacitor Clc, and a sustain capacitor Cst. If necessary, the sustain capacitor Cst may be omitted.

The switching element Q is a 3-terminal element such as a thin film transistor formed on a lower substrate (not shown) of the panel assembly 52. That is, the switching element Q includes a control terminal connected to the first scan line $S_i$, an input terminal connected to the data line $D_j$, and an output terminal connected to the liquid crystal and sustain capacitors Clc, Cst.

The gradation voltage generation unit 106 generates two groups of gradation voltages (or two groups of reference gradation voltages) related to the transmittance of the first pixels PX. One of the two groups has a positive value with respect to a common voltage Vcom and the other has a negative value.

The first scan driver unit 102 is connected to the first scan lines $S_1$-$S_n$ of the panel assembly 52 to apply a scan signal that is a combination of a switch-on-voltage Von and a switch-off-voltage Voff to the first scan lines $S_1$-$S_n$.

The first data driver unit 104 is connected to the first data lines $D_1$-$D_m$ of the panel assembly 52. The first data driver unit 104 selects a gradation voltage from the gradation voltage generation unit 106 and applies the selected gradation voltage to the first data lines $D_1$-$D_m$. However, when the gradation voltage generation unit 106 does not provide all of the voltages for all of the gray levels but provides only the predetermined number of reference gradation voltages, the first data driver unit 104 divides the reference gradation voltages, generates the gradation voltages for all of the gray levels, and selects a data signal from the gradation voltages.

The signal control unit 108 controls the first scan driver unit 102 and the first data driver unit 104. The backlight control unit 110 controls the second scan and second data driver units 114, 112 of the light emission device 10. The signal control unit 108 receives input image signals R, G, B and an input control signal for controlling the display of the input image signals R, G, B from an external graphic controller (not shown).

The input image signals R, G, B have luminance information of each first pixel PX. The luminance has the predetermined number of gray levels (e.g., 1024(=$2^{10}$), 256(=$2^8$), or 64(=$2^6$) gray levels). The input control signal may be a vertical synchronizing signal Vsync, a horizontal synchronizing signal Hsync, a main clock MCLK, or a data enable signal DE.

The signal control unit 108 properly processes the input image signals R, G, B in response to the operating condition of the panel assembly 52 with reference to the input image signals R, G, B and the input control signal, generates a first scan driver unit control signal CONT1 and a first data driver unit control signal CONT2, transmits the first scan driver unit control signal CONT1 to the first scan driver unit 102, and transmits the first data driver unit control signal CONT2 and the processed image signal DAT to the first data driver units 104.

The display unit 116 of the light emission device 10 includes a plurality of second pixels EPX, each of which is connected to one of second scan lines $S'_1$-$S'_p$ and one of second data lines $C_1$-$C_q$ . Each second pixel EPX emits light according to a difference between the voltages applied to the second scan lines $S'_1$-$S'_p$ and the second data lines $C_1$ -$C_q$. The second scan lines $S'_1$-$S'_p$ correspond to the scan electrodes of the light emission device 10 while the second data lines $C_1$-$C_q$ correspond to the data electrodes of the light emission device 10.

The signal control unit 108 generates a light emission control signal of the light emission device 10 using the input image signals R, G, B with respect to the plurality of first pixels PX corresponding to one of the second pixels EPX of the light emission device 10. The light emission control signal includes a second data driver unit control signal CD, a light emission signal CLS and a second scan driver unit control signal CS. Each second pixel EPX of the light emission device 10 emits light in response to the light emission of the first pixels PX according to the second data driver unit control signal CD, the light emission signal CLS and the second scan driver unit control signal CS.

The signal control unit 108 detects a highest gray level among the plurality of first pixels PX (Hereinafter, "first pixel group") using the input image signals R, G, B with respect to the first pixel group PX corresponding to one of the second pixels EPX of the light emission device 10, and transmits the detected highest gray level to the backlight control unit 110. The backlight control unit 110 calculates the gray level required for exciting the second pixel EPX according to the detected highest gray level, converts the calculated gray level into digital data, and transmits the digital data to the second data driver unit 112.

In this embodiment, the light emission signal CLS includes digital data above 6-bit to represent the gray level of the second pixel EPX. The second data driver unit control signal CD allows each second pixel EPX to emit light by synchronizing with the corresponding first pixel group PX. That is, the second pixel EPX is synchronized with the corresponding first pixel group PX in response to the image and emits the light with a predetermined gray level.

The second data driver unit 112 generates a second data signal according to the second data driver unit control signal CD and the light emission signal CLS and transmit the second data signal to the second data lines $C_1$-$C_q$.

In addition, the backlight control unit 110 generates the second scan driver unit control signal CS of the light emission device 10 using a horizontal synchronizing signal Hsync. That is, the second scan driver unit 114 is connected to the second scan lines $S'_1$-$S'_p$. The second scan driver unit 114 generates a second scan signal according to the second scan driver unit control signal CS and transmit the second scan signal to the second scan lines $S'_1$-$S'_p$. While a switch-on-voltage Von is applied to the plurality of first pixels PX corresponding to one of the second pixels EPX of the light emission device 10, the second scan signal is applied to the second scan line $S'_1$-$S'_p$ of the second pixel EPX.

Then, the second pixels EPX emit light in response to the gray level of the corresponding first pixel group PX according to the second scan voltage and the second data voltage. In this embodiment, a voltage corresponding to the gray level may be applied to the second data lines $C_1$-$C_q$ of the second pixels EPX while a fixed voltage may be applied to the second scan lines $S'_1$-$S'_p$. The second pixels EPX emit light according to a voltage difference between the scan and data lines.

As a result, the display device in accordance with the present invention can enhance the dynamic contrast of the screen, thereby improving the display quality.

Even when a high voltage above 10 kV is applied to the anode electrode, the electric charges formed on the spacer can be effectively discharged to the external side without generating a short circuit between the driving and anode electrodes. As a result, the luminance non-uniformity problem caused by the charging of the spacer can be prevented.

Although exemplary embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A light emission device comprising:

a vacuum envelope comprising a first substrate and a second substrate facing each other;

an electron emission unit on the first substrate;

a light emission unit on the second substrate for emitting light using electrons from the electron emission unit; and a spacer for uniformly maintaining a gap between the first and second substrates, the spacer comprising a first surface, a second surface opposite and spaced apart from the first surface, and a third surface extending between the first and second surfaces in a direction extending from the first substrate toward the second substrate, wherein the third surface of the spacer has a surface resistivity $10^{12}$-$10^{14}$ Ωcm.

2. The light emission device of claim 1, wherein the spacer comprises:

a spacer body comprising the first, second, and third surfaces; and a coating layer on at least one of the first, second, and third surfaces, the coating layer having a resistivity of $10^{12}$-$10^{14}$ Ωcm.

3. The light emission device of claim 2, wherein the coating layer is on the third surface.

4. The light emission device of claim 3, wherein the coating layer is on at least one of the first and second surfaces.

5. The light emission device of claim 2, wherein the coating layer is on at least one of the first and second surfaces.

6. The light emission device of claim 2, wherein the coating layer is on an entire surface of at least one of the first, second, and third surfaces.

7. The light emission device of claim 2, wherein the coating layer comprises chrome oxide.

8. The light emission device of claim 7, wherein the light emission unit comprises:

a phosphor layer; and an anode electrode on a surface of the phosphor layer, wherein the anode electrode receives a voltage of 10-15 kV.

9. The light emission device of claim 2, wherein the spacer has a pillar shape or a wall shape.

10. The light emission device of claim 2, wherein the electron emission unit comprises:

first electrodes and second electrodes crossing each other and insulated from each other; and an electron emission region electrically connected to the first electrodes or the second electrodes.

11. The light emission device of claim 10, wherein the spacer contacts the first electrodes or the second electrodes.

12. The light emission device of claim 10, wherein the electron emission region comprises at least one of a carbon-based material or a nanometer-sized material.

13. The light emission device of claim 1, wherein the gap between the first and second substrates is 5-20 mm.

14. A light emission device comprising:

a vacuum envelope comprising a first substrate and a second substrate facing each other;

an electron emission unit on the first substrate;

a light emission unit on the second substrate for emitting light using electrons from the electron emission unit; and a spacer for uniformly maintaining a gap between the first and second substrates, wherein the spacer has a surface resistivity of $10^{12}$-$10^{14}$ Ωcm, wherein the spacer comprises a spacer body and a coating layer on at least one of a top surface and a bottom surface of the spacer body, and wherein the coating layer has a resistivity of $10^{12}$-$10^{14}$ Ωcm and a thickness of 2-4 mm.

15. A display device comprising:

a light emission device comprising:

a vacuum envelope comprising a first substrate and a second substrate facing each other;

an electron emission unit on the first substrate;

a light emission unit on the second substrate for emitting light using electrons from the electron emission unit; and a spacer for uniformly maintaining a gap between the first and second substrates, the spacer comprising a first surface, a second surface opposite and spaced apart from the first surface, and a third surface extending between the first and second surfaces in a direction extending from the first substrate toward the second substrate, wherein the third surface of the spacer has a surface resistivity of $10^{12}$-$10^{14}$ Ωcm; and a panel assembly spaced apart from the light emission device to display an image in response to light emitted from the light emission device.

16. The display device of claim 15, wherein the panel assembly is a liquid crystal panel assembly.

17. A display device comprising:

a light emission device comprising:

a vacuum envelope comprising a first substrate and a second substrate facing each other;

an electron emission unit on the first substrate;

a light emission unit on the second substrate for emitting light using electrons from the electron emission unit; and a spacer for uniformly maintaining a gap between the first and second substrates, wherein the spacer has a surface resistivity of $10^{12}$-$10^{14}$ Ωcm; and a panel assembly spaced apart from the light emission device to display an image in response to light emitted from the light emission device, wherein the panel assembly includes a plurality of first pixels in a panel assembly matrix of first pixel rows and first pixel columns, and wherein the light emission device includes a plurality of second pixels in a light emission device matrix of second pixel rows and second pixel columns, the number of second pixels being less than the number of the first pixels, the second pixels emitting different intensities of light.

18. The display device of claim 17, wherein the number of first pixels in each first pixel row is more than 240 and the number of first pixels in each first pixel column is more than 240.

19. The display device of claim 17, wherein the number of second pixels in each second pixel row is within a range of 2-99 and the number of second pixels in each second pixel column is within a range of 2-99.

* * * * *